US005692490A

United States Patent [19]

Walker

[11] Patent Number: 5,692,490

[45] Date of Patent: Dec. 2, 1997

[54] ARCHERY RELEASE

[75] Inventor: Dean Walker, Vermilion, Ohio

[73] Assignee: Teijo Villa, Terrace Bay, Canada

[21] Appl. No.: 470,322

[22] Filed: Jun. 6, 1995

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 3,768,456 | 10/1973 | Hansen et al. | 124/35.2 |
| 3,853,111 | 12/1974 | Stanislawski et al. | 124/35.2 |
| 4,424,791 | 1/1984 | Muehleisen | 124/35.2 |
| 4,612,907 | 9/1986 | Gantt | 124/35.2 |
| 4,877,009 | 10/1989 | Becker | 124/35.2 |
| 5,025,772 | 6/1991 | Stevenson | 124/35.2 |
| 5,031,600 | 7/1991 | Moore | 124/35.2 |
| 5,247,921 | 9/1993 | Todd | 124/35.2 |

*Primary Examiner*—John A. Ricci
*Attorney, Agent, or Firm*—Hoffman, Wasson & Gitler

[57] ABSTRACT

An archery release is provided utilizing ball bearings in the fulcrum or centerline of the drawing or pulling force. The release rotates about the bearing centerline to disengage a sear mechanism, thereby releasing a bowstring from a loop of cord connected to the sear mechanism.

16 Claims, 4 Drawing Sheets

ARCHERY RELEASE

BACKGROUND OF THE INVENTION

1. Field of Invention

The present invention relates to a mechanical archery release. More particularly, the present invention relates to a mechanical triggering device for releasing a bowstring to shoot an arrow, and utilizes ball bearings at the fulcrum of the drawing or pulling force.

2. Description of the Prior Art

Archers are constantly seeking better target scores. To that end, release aids are growing in popularity. Release aids grasp the bowstring at a point, thereby eliminating finger pinch which can hinder accuracy.

A wide variety of bowstring release devices are known. U.S. Pat. No. 5,247,921 to Todd discloses an archery bowstring release in which the bowstring is held in the stressed position by two rollers. Two carrier members move the rollers apart so the bowstring can pass between the rollers when a trigger element is depressed.

U.S. Pat. No. 5,031,600 illustrates an archery bowstring release in which the bowstring is held in the stressed position by a hook member. A hook release lever retains the hook so that the string is kept in the drawn position. When the trigger is depressed, the hook release lever causes the hook to move, thereby releasing the bowstring.

Stanislawski et al, U.S. Pat. No. 3,853,111, relates to a well-known bowstring release in which the bowstring is held by a looped cord. The looped cord is held by a hooked pin. When the hand grip is rotated, the loop slips off the hooked pin to release the bowstring. U.S. Pat. Nos. 5,025,772; and 4,877,009 to Stevenson and Becker, respectively, show releases similar to Stanislawski et al.

All of the foregoing releases are intended to provide a greater degree of accuracy than a bowstring held simply by the archer's fingers. However, conventional releases, such as these, have drawbacks, including susceptibility to temperature, humidity, the coefficient of friction in the pivotal drawing finger, and a draw cycle which varies from shot to shot. Variation in the coefficient of friction leads to inconsistent sear engagement, and/or premature firing of the release.

Furthermore, the releasing action of many devices can, itself, hinder accuracy by creating disturbing and undesirable motion during the bowstring release.

SUMMARY OF THE INVENTION

The present invention pertains to an archery release utilizing ball bearings in the fulcrum or centerline of the drawing or pulling force. The index finger acts as the main drawing force. The release rotates about the bearing centerline to disengage the sear mechanism so that the shot can be made. The release of the present invention provides a completely repeatable draw cycle with no variation from shot to shot.

It is an object of the present invention to provide an archery release which is not susceptible to humidity, temperature and the coefficient of friction in the pivotal drawing finger.

It is another object of the present invention to provide an archery release in which the amount of pressure required to rotate the release does not vary.

Another object of the present invention is to provide an archery release having a repeatable draw cycle.

Yet another object of the present invention is to provide an archery release having an adjustable middle finger tang to accommodate different hand or finger sizes to provide sufficient comfort and fit.

BRIEF DESCRIPTION OF THE DRAWINGS

The foregoing and other objects and attributes of the present invention will be described with respect to the following drawings in which.

DETAILED DESCRIPTION OF THE PREFERRED EMBODIMENTS

Figure 1:
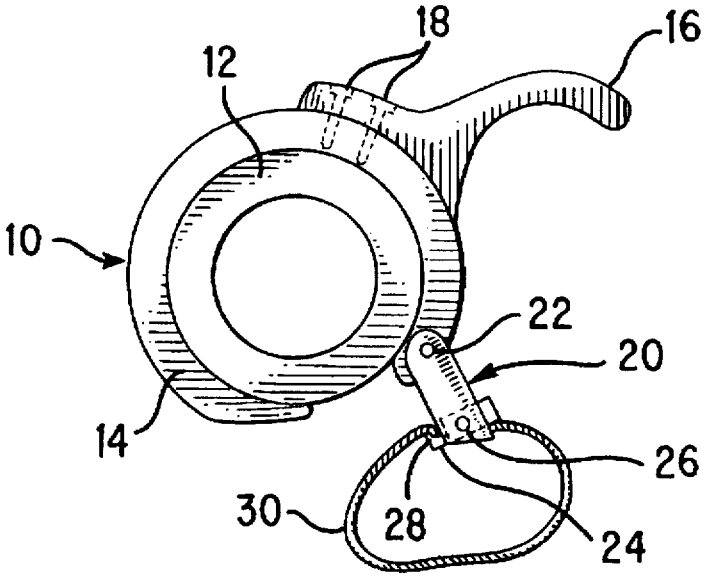
FIG. 1 is a side view of a first embodiment of the archery release of the present invention.
Figure 2:
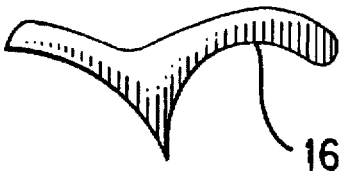
FIG. 2 is a side view of the finger tang of the archery shown in FIG. 1.
Figure 3:
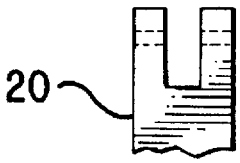
FIG. 3 is a partial front view of the sear of the archery release shown in FIG. 1.

Referring to FIGS. 1–3, a first embodiment of an archery release according to the present invention is illustrated. The release 10 includes a circular race 12 which supports ball bearings (not shown). The race 12 is surrounded by a housing or shell 14. A finger tang 16 is attached by screws 18 to the housing 14. A sear 20 is attached to the housing 14 by a hinge pin 22, and rotates freely about the hinge pin 22. A secondary sear 24 is attached to the sear 20 by a hinge pin 26. A notch 28 is provided in one end of the secondary sear 24.

The housing 14 rotates about the race 12 when an archer pulls on the tang 16 The loop of cord 30 is wrapped around a bowstring, (not shown) and is attached to the notch 28 in the secondary sear 24.

As a result of such construction, the race 12 containing the ball bearings is located at the fulcrum or centerline of the drawing or pulling force. The index finger provides the main drawing force on the bearing race 12. The bowstring is released when the archer applies force to the tang 16 by the middle finger, so that the housing 14 rotates around the bearing centerline causing the sear 20 to rotate about hinge pin 22, and secondary sear 24 to rotate about hinge pin 26, thereby disengaging the loop of cord 30 from the notch 28, allowing an arrow to fly. The foregoing construction provides a completely repeatable draw cycle which does not vary from one shot to another.

Since the release 10 is virtually frictionless in its rotation, there is correspondingly little variation in the amount of pressure required to rotate the release. The release 10 does not suffer from the effects of temperature, humidity and/or the coefficient of friction due to its pivoting about the index finger. Unlike conventional release, the release 10 does not experience the problem of inconsistent sear engagement and/or premature firing of the release.

In order to accommodate different hand and/or finger sizes, the tang 16 is adjustable. The screws 18 allow the position of the tang 16 to be moved about the circumference of the housing 14.

It is expected that the parts of the release 10 are made from various metals and/or plastics with the loop of cord being made from known rope materials.

The second embodiment, shown in FIGS. 4–7B, is similar to the first embodiment, and similar elements bear corresponding reference numbers. In this embodiment the housing 14 is formed from an inner shell 40 and an outer shell 42. As seen in FIGS. 5A and 5B, the inner shell 40 has two ball bearing grooves 44 formed on its outer surface 46, and the outer shell 42 has corresponding ball bearing grooves 48 on its inner surface 50. Small bearings can be inserted through two pre-drilled and tapped holes 52 in the outer shell 42, as shown in FIG. 5B.

The outer shell 42 performs the function of the housing 14 of the first embodiment shown in FIGS. 1–3. The inside diameter of the finger hole in the inner shell 40 is larger than the first embodiment in order to accommodate a greater range of finger sizes.

Since smaller bearings are used, than in the first embodiment, the bearing wall thickness is smaller thereby making the release 10 more compact.

Figure 6A:
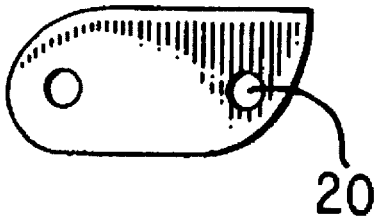
FIGS. 6A and 6B are side and front views, respectively, of the sear of the release shown in FIG. 4.
Figure 6B:
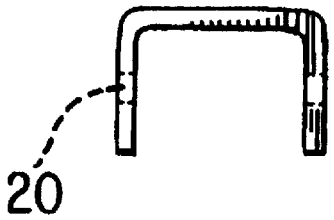
Figure 7A:
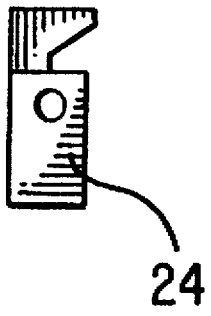
FIGS. 7A and 7B are side and front views, respectively, of the secondary sear of the archery release shown in FIG. 4.
Figure 7B:
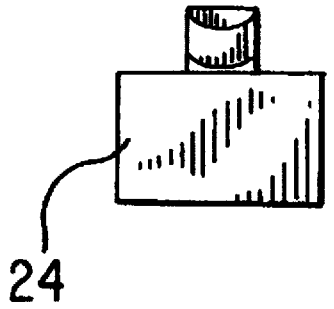

A hinge pin hole 60 is made in the outer shell 42 to connect the sear 20, shown in FIGS. 6A and 6B. The secondary sear 24, shown in detail in FIGS. **7*a* and 7*b*, is attached to the sear 20** in the same manner as in the first embodiment.

Figure 4:
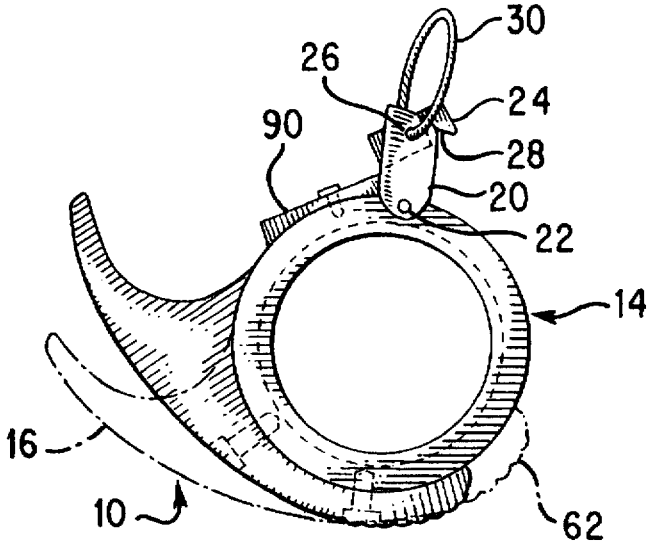
FIG. 4 is a side view of a second embodiment of the archery release of the present invention.
Figure 5A:
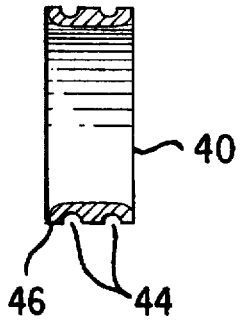
FIG. 5A is a cross-sectional view of an inner shell of the release shown in FIG. 4.
Figure 5B:
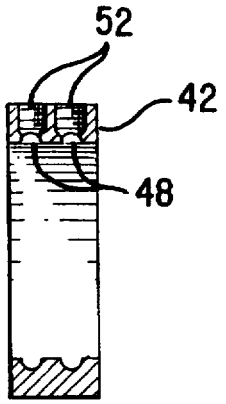
FIG. 5B is a cross-sectional view of an outer shell of the release shown in FIG. 5.

The tang 16', shown in FIG. 4, differs from the tang 16 in that it has a serrated section 62 on the thumb side of the release 10. The serrated section 62 helps to draw the release and assists in the forward action of the thumb during triggering of the release 10.

The release 10 operates as follows. The archer takes the release cord 30 and hooks it around the bow string, and attaches it to the notch 28 in the secondary sear 24 while the secondary sear 24 abuts the shear 90. With an index finger extending through the opening in the housing 14, the archer draws the bow, applies pressure with the middle finger o the tang 16', and rotates the release 10 so that the seondary sear 24 releases the cord 30, in turn releasing the bow string. The secondary sear 24 is positioned as shown in FIG. 4 so that it is on top of the upper surface of the shear 90, in the drawn position. As the outer shell, 42 is rotated, the secondary sear 24 slips off the edge of the sear 90 causing the secondary sear 24 to rotate, thereby releasing the cord 30 and the bow string.

Figure 8:
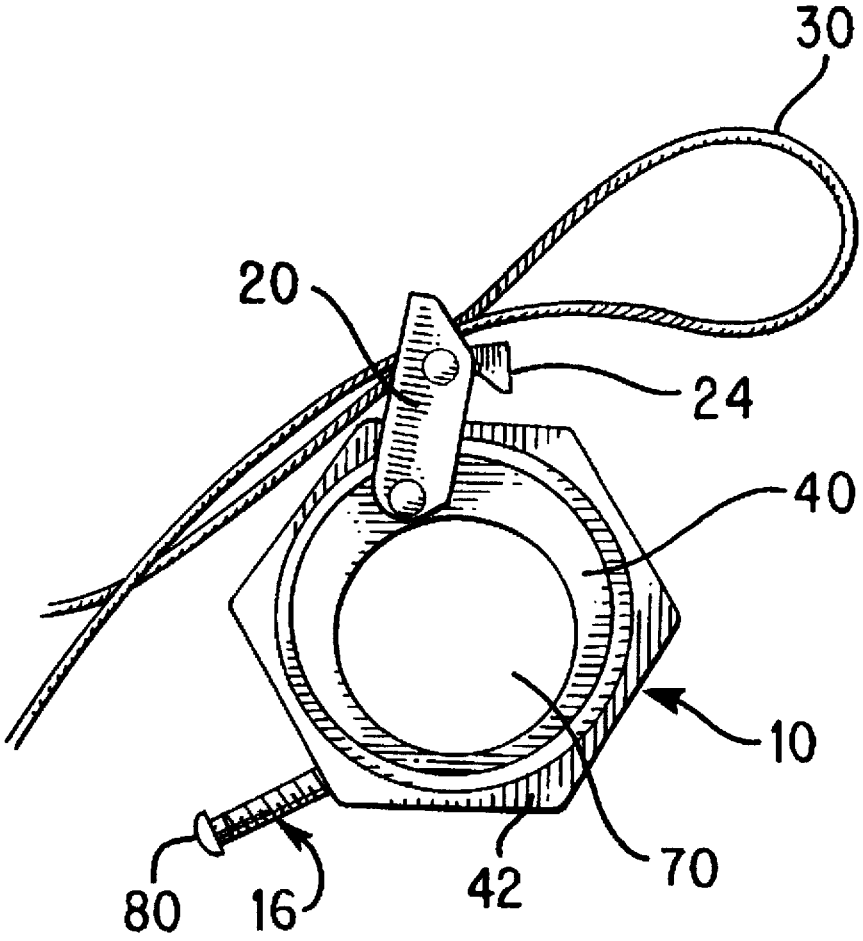
FIG. 8 is a side view of a third embodiment of archery release of the present invention.

FIG. 8 shows a third embodiment of the present invention. The main difference from the first and second embodiments is the off-center boring of the finger hole 70 in the inner shell 40' to create an eccentric inner shell 40'. As a result of the eccentric finger hole 70, extra stock material is provided on one side of the inner shell 40' which makes creating the hinge pin hole 60 easier in the wider side. The tang 16 of the first and second embodiments is replaced by a stud 80 which is threaded, and screws into a hole in the outer shell 42. Unlike the previous embodiments, the hinge pin 22 is inserted into the inner shell 40 and not the outer shell 42.

As the outer shell 42 is rotated, the loop of cord 30 is not rotated to one side, as is common in conventional releases. Consequently, the loop of cord 30 stays in a straight line with the drawing force of the bow. Only the secondary sear 24 is rotated away from the cord 30, thereby eliminating any effect on the straight-line pull.

In FIG. 8, the outer shell 42 is hexagonal, to provide a tighter, more compact release 10. Furthermore, the hexagonal shape makes construction quicker and easier, and facilitates the attachment of the stud 80.

When the hinge pin 22 is mounted on the inner shell 40, opposing forces cancel most friction in the release assembly 10, because as the finger applies force away from the bow, the resistance of the draw weight of the bow creates an equal force in the opposite, forward direction. The only load on the bearing is the leverage of the sear 20 against the shear.

The release 10 is also applicable to other projectile devices, such as a cross-bow, where heavy weight loading on the sear is excessive. The trigger will be smoother, more precise, lighter, and will have a longer life. For example, a 150 lbs crossbow with no let-off has 150 lbs load on the sear. Even if the crossbow has eccentric wheels, there will still be up to 50% of the 150 lbs load on the sear. The release of the present invention can drastically reduce the load on the sear.

Having described several embodiments of the release in accordance with the present invention, it is believed that other modifications, variations, and changes will be suggested to those skilled in the art in view of the description set forth above. For example, the release need not use ball bearings, but could use needle bearings. Alternatively, the inner and outer shells can be provided with Teflon™ or other low coefficient of friction material between the two shells. Furthermore the inner shell could also be made from low friction material, negating the need for the bearing medium between the shells. The shape of the outer shell or housing can also assume a wide variety of constructions. It is therefore to be understood that all such variation, modifications and changes are believed to fall within the scope of the invention as defined in appended claims.

We claim:

1. A release for use with an archery bow, comprising:

an inner shell or race having a hole for accommodating a first finger, an outer shell surrounding said race and rotatable relative said race, a tang, mounted to said outer shell and extending away from said race, to accommodate a second finger, a sear pivotally attached to one of said race or said outer shell, a secondary sear pivotally attached to said sear, said secondary sear having a notch provided in an end, a loop of cord being wrapped about a bowstring of said archery bow and disposable in said notch to draw said bow, a shear mounted to said outer shell and rotatable between a first position in which said shear can engage said secondary sear so that said secondary sear retains said loop of cord and a second position in which said shear disengages from said secondary sear to allow said secondary sear to pivot and release said loop of cord, wherein to draw said bowstring, said shear is initially in said first position, and an archer pulls back on said release with said first finger, and to release said bowstring, said archer pulls on said tang with said second finger to rotate said outer shell and said shear to said second position to allow said secondary sear to rotate to release said cord.

2. A release as recited in claim 1, said inner shell and said outer shell supporting ball bearings therebetween.

3. A release as recited in claim 2, wherein said sear is pivotally attached to said outer shell.

4. A release is recited in claim 2, wherein said sear is pivotally attached to said inner shell.

5. A release as recited in claim 4, wherein said hole is disposed eccentrically in said inner shell.

6. A release as recited in claim 5, wherein said sear is attached to said inner shell by a hinge pin extending through a wider part of said inner shell.

7. A release as recited in claim 2, wherein said outer shell comprises a hole in an outer surface so that said ball bearings can be inserted.

8. A release as recited in claim 2, wherein said inner shell has a groove on an outer circumference and said outer shell has a groove on an inner circumference, said ball bearings being disposed in said groove in said inner shell and said groove in said outer shell.

9. A release as recited in claim 8, wherein said outer shell comprises a hole in an outer surface so that said ball bearings can be inserted.

10. A release as recited in claim 8, wherein said inner and outer shells each have a pair of grooves.

11. A release as recited in claim 2, wherein said outer shell is hexagonal.

12. A release as recited in claim 11, wherein said tang is a thread stud screwed into said outer shell.

13. A release as recited in claim 1, wherein said hole is disposed eccentrically in said race.

14. A release as recited in claim 1, wherein said tang has a serrated portion on an outer surface.

15. A release as recited in claim 1, wherein said sear is attached by a hinge pin.

16. A release as recited in claim 1, wherein said tang is attached by screws.

* * * * *